US009922812B2

(12) United States Patent
Makarov

(10) Patent No.: US 9,922,812 B2
(45) Date of Patent: Mar. 20, 2018

(54) METHOD OF MASS SEPARATING IONS AND MASS SEPARATOR

(71) Applicant: Thermo Fisher Scientific (Bremen) GmbH, Bremen (DE)

(72) Inventor: Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/346,684

(22) Filed: Nov. 8, 2016

(65) Prior Publication Data

US 2017/0053790 A1 Feb. 23, 2017

Related U.S. Application Data

(62) Division of application No. 13/989,719, filed as application No. PCT/EP2011/070961 on Nov. 24, 2011.

(30) Foreign Application Priority Data

Nov. 26, 2010 (GB) ..... 1020039.2

(51) Int. Cl.
*H01J 47/00* (2006.01)
*H01J 49/40* (2006.01)
*H01J 49/42* (2006.01)

(52) U.S. Cl.
CPC ..... *H01J 49/406* (2013.01); *H01J 49/4245* (2013.01)

(58) Field of Classification Search
None
See application file for complete search history.

(56) References Cited

U.S. PATENT DOCUMENTS 5,886,346 A * 3/1999 Makarov ..... H01J 49/425 250/290
7,728,290 B2 * 6/2010 Makarov ..... H01J 49/425 250/281
7,767,960 B2 * 8/2010 Makarov ..... H01J 49/0009 250/281
7,989,758 B2 * 8/2011 Koster ..... H01J 49/425 250/282
8,384,019 B2 * 2/2013 Koster ..... H01J 49/425 250/281

(Continued)

FOREIGN PATENT DOCUMENTS

GB 2470599 A 12/2010
GB 2470600 A * 12/2010 ..... H01J 49/406

(Continued)

*Primary Examiner* — Andrew Smyth
(74) *Attorney, Agent, or Firm* — Nicholas Cairns

(57) ABSTRACT

An analyzer for separating ions according to their time of flight comprising two opposing ion mirrors abutting at a first plane, each mirror comprising inner and outer field-defining electrode systems elongated along an analyzer axis, the outer field-defining electrode system surrounding the inner field-defining electrode system. The outer field-defining electrode system of one mirror comprises two sections, the sections abutting at a second plane, comprising a first section between the first plane and the second plane, and a second section adjacent to the first section. The first section has at least a portion which extends radially from the analyzer axis a greater extent than an adjacent portion of the second section at the second plane. The outer field-defining electrode system comprises an exit port and the analyzer comprises a detector located downstream of the exit port.

10 Claims, 4 Drawing Sheets

(56) References Cited

U.S. PATENT DOCUMENTS

| | | | | |
|---|---|---|---|---|
| 8,592,750 | B2 * | 11/2013 | Makarov | H01J 49/0009 250/281 |
| 2004/0108450 | A1 * | 6/2004 | Makarov | B82Y 30/00 250/281 |
| 2005/0121609 | A1 * | 6/2005 | Makarov | B82Y 30/00 250/290 |
| 2005/0167585 | A1 * | 8/2005 | Makarov | B82Y 30/00 250/290 |
| 2006/0124845 | A1 * | 6/2006 | Makarov | G01N 27/62 250/282 |
| 2007/0023629 | A1 * | 2/2007 | Makarov | H01J 49/004 250/282 |
| 2007/0187585 | A1 * | 8/2007 | Verentchikov | H01J 49/004 250/287 |
| 2007/0273385 | A1 * | 11/2007 | Makarov | G01N 27/62 324/464 |
| 2008/0258053 | A1 * | 10/2008 | Makarov | H01J 49/004 250/283 |
| 2008/0315080 | A1 * | 12/2008 | Makarov | H01J 49/425 250/281 |
| 2013/0068942 | A1 * | 3/2013 | Verenchikov | H01J 49/4245 250/282 |

FOREIGN PATENT DOCUMENTS

| | | | | |
|---|---|---|---|---|
| GB | 2470600 | B * | 6/2012 | H01J 49/406 |
| WO | 2007/000587 | A2 | 1/2007 | |
| WO | 2010/136533 | A1 | 12/2010 | |
| WO | 2010/136534 | A1 | 12/2010 | |
| WO | WO 2010136534 | A1 * | 12/2010 | H01J 49/406 |

* cited by examiner

METHOD OF MASS SEPARATING IONS AND MASS SEPARATOR

CROSS-REFERENCE TO RELATED APPLICATION

This application is a divisional under 35 U.S.C. § 121 and claims the priority benefit of co-pending U.S. patent application Ser. No. 13/989,719, filed May 24, 2013, which is the United States National Stage Application, under 35 U.S.C. 371, of International Application PCT/EP2011/070961 having an international filing date of Nov. 24, 2011. The disclosures of each of the foregoing applications are incorporated herein by reference.

FIELD OF THE INVENTION

This invention relates to the field of mass separating ions, and in particular to methods and apparatus for the separating of ions using time-of-flight (TOF) multi-reflection (MR) mass analyzers.

BACKGROUND

Time-of-flight mass spectrometers are widely used to determine the mass to charge ratio of charged particles on the basis of their flight time along a path. The charged particles, usually ions, are emitted from a pulsed source in the form of a packet, and are directed along a prescribed flight path through an evacuated space to impinge upon or pass through a detector. (Herein ions will be used as an example of charged particles.) In its simplest form, the path follows a straight line and in this case ions leaving the source with a constant kinetic energy reach the detector after a time which depends upon their mass to charge ratio, more massive ions being slower. The difference in flight times between ions of different mass-to-charge ratio depends upon the length of the flight path, amongst other things; longer flight paths increasing the time difference, which leads to an increase in mass resolution. When high mass resolution is required it is therefore desirable to increase the flight path length. However, increases in a simple linear path length lead to an enlarged instrument size, increasing manufacturing cost and require more laboratory space to house the instrument.

Various solutions have been proposed to increase the path length whilst maintaining a practical instrument size, by utilising more complex flight paths. Many examples of charged particle mirrors or reflectors have been described, as have electric and magnetic sectors, some examples of which are given by H. Wollnik and M. Przewloka in the Journal of Mass Spectrometry and Ion Processes, 96 (1990) 267-274, and G. Weiss in U.S. Pat. No. 6,828,553. In some cases two opposing reflectors or mirrors direct charged particles repeatedly back and forth between the reflectors or mirrors; offset reflectors or mirrors cause ions to follow a folded path; sectors direct ions around in a ring or a figure of "8" racetrack. Herein the terms reflector and mirror are used interchangeably and both refer to ion mirrors or ion reflectors unless otherwise stated. Many such configurations have been studied and will be known to those skilled in the art.

Electrostatic trapping is also well known and a class of traps utilise orbital trapping. Orbital electrostatic trapping was demonstrated by K. H. Kingdon (Phys. Rev. 21 (1923) 408) in a trap comprising an outer electrode structure and an inner electrode structure, the outer structure surrounding the inner. Ions orbit about the inner electrode structure in the region between the inner and outer electrode structures.

A type of orbital electrostatic trap utilising opposing linear fields which result in harmonic ion oscillations in the direction of an analyzer axis is used in the Orbitrap™ mass analyzer, of A. A. Makarov (U.S. Pat. No. 5,886,346 and Anal. Chem. 72 (2000) 1156). A single spindle-like inner electrode structure is surrounded by an outer electrode structure of barrel-like form.

C. Köster (Int. J. Mass Spectrom. Volume 287, Issues 1-3, pages 114-118 (2009)) describes harmonic ion trapping in structures comprising a plurality of inner electrodes all surrounded by an outer electrode structure.

However these prior art electrostatic traps in which ions orbit around inner electrodes and/or the analyzer axis as so described have not been used to function as time of flight mass spectrometers as ions spread out around the inner electrode(s) with ions of the same mass to charge ratio forming rings. Ejection of such rings to a detector cannot be accomplished easily without disrupting other rings of ions within the trap and means to sequentially eject ions of increasing or decreasing mass to charge ratio so as to produce a spectrum were not provided.

Patent SU1716922 describes a two-reflection TOF analyzer comprising opposing mirrors elongated along an analyzer axis. The mirrors comprise concentric cylinders and ion motion in a direction parallel to the analyzer axis is not harmonic. Ions enter the analyzer through an aperture set inside the diameter of an outer cylindrical electrode and follow a helical trajectory of constant radius about an inner cylindrical electrode before emerging from an exit aperture and impinging upon a detector. In this apparatus the entrance aperture is set into the analyzer structure at the radius at which ions are to circulate. The same or a further aperture is also set into the analyzer structure at the radius at which ions are to circulate to enable ions to leave the analyzer. The presence of the inset apertures would otherwise distort the field within the analyzer and to prevent this, field correction electrodes must be incorporated into the analyzer. As described, these introduced obstacles on the path of the ions and the fringe field correction was not perfect, resulting in a reduction in sensitivity and resolution of the spectrometer. Most importantly, the presence of fringe field correction electrodes limited the number of oscillations to just one full oscillation (one back and one forward pass).

Against this background, the present invention has been made.

A brief glossary of terms used herein for the invention is provided below for convenience; a fuller explanation of the terms is provided at relevant places elsewhere in the description.

Analyzer electrical field (also termed herein analyzer field): The electric field within the analyzer volume between the inner and outer field-defining electrode systems of the mirrors, which is created by the application of potentials to the field-defining electrode systems. The main analyzer field is the analyzer field in which the charged particles move along one or more main flight paths.

Analyzer volume: The volume between the inner and outer field-defining electrode systems of the two mirrors. The analyzer volume does not extend to any volume within the inner field-defining electrode system, nor to any volume outside the inner surface of the outer field-defining electrode system.

Angle of orbital motion: The angle subtended in the arcuate direction as the orbit progresses.

Arcuate direction: The angular direction around the longitudinal analyzer axis z. FIG. 1 shows the respective directions of the analyzer axis z, the radial direction r and the arcuate direction ø, which thus can be seen as cylindrical coordinates.

Arcuate focusing: Focusing of the charged particles in the arcuate direction so as to constrain their divergence in that direction.

Asymmetric mirrors: Opposing mirrors that differ either in their physical characteristics (size and/or shape for example) or in their electrical characteristics or both so as to produce asymmetric opposing electrical fields.

Beam: The train of charged particles or packets of charged particles some or all of which are to be separated.

Belt electrode assembly: A belt-shaped electrode assembly extending at least partially around the analyzer axis z.

Charged particle accelerator: Any device that changes either the velocity of the charged particles, or their total kinetic energy either increasing it or decreasing it.

Charged particle deflectors: Any device that deflects the beam.

Detector: All components required to produce a measurable signal from an incoming charged particle beam.

Ejector: One or more components for ejecting the charged particles from the main flight path and optionally out of the analyzer volume.

Entry port: portal through which ions pass on joining a main flight path. The portal may be within the analyzer volume or at the boundary of the analyzer volume.

Equator, or equatorial position of the analyzer: The midpoint between the two mirrors along the analyzer axis z, i.e. the point of minimum absolute electrical field strength in the direction of the analyzer axis z within the analyzer volume.

Exit port: portal through which ions pass on leaving a main flight path as they proceed to leave the analyzer volume. The portal may be within the analyzer volume or at the boundary of the analyzer volume.

Field-defining electrode systems: Electrodes that, when electrically biased, generate, or contribute to the generation of, or inhibit distortion of the analyzer field within the analyzer volume.

Injector: One or more components for injecting the charged particles onto the main flight path through the analyzer.

Main flight path: The stable trajectory that is followed by the charged particles for the majority of the time that the particles are being separated. The main flight path is followed predominantly under the influence of the main analyzer field. There may be a plurality of main flight paths.

m/z: Mass to charge ratio

Receiver: Any charged particle device that forms all or part of a detector or device for further processing of the charged particles.

SUMMARY OF INVENTION

According to the present invention, in a first independent aspect, there is provided a method of separating ions according to their time of flight comprising: providing an analyzer comprising two opposing ion mirrors, each mirror comprising inner and outer field-defining electrode systems elongated along an analyzer axis with the outer field-defining electrode system surrounding the inner field-defining electrode system and creating therebetween an analyzer volume; injecting ions into the analyzer volume or creating ions within the analyzer volume so that they separate according to their time of flight as they travel along a main flight path whilst undergoing a plurality of axial oscillations in the direction of the analyzer axis and a plurality of radial oscillations whilst orbiting about one or more inner field-defining electrodes; the plurality of axial oscillations and plurality of radial oscillations causing the separated ions to intercept an exit port after a predetermined number of orbits.

Preferably the opposing ion mirrors comprise electrostatic ion mirrors, formed from inner and outer field-defining electrode systems elongated along an analyzer axis with the outer field-defining electrode system surrounding the inner field-defining electrode system, as will be further described. Each electrode system may comprise one or more electrodes. Preferably the opposing mirrors abut at a plane. The opposing mirrors utilise an analyzer field which comprises opposing electrostatic fields produced within the analyzer volume, i.e. the volume between the inner and outer field-defining electrode systems. Preferably the opposing electrostatic fields are substantially linear opposing fields and ion motion in the direction of the analyzer axis is harmonic. Ions may be injected into the analyzer volume using an injector such as a pulsed ion source, for example a C-trap, which may comprise a storage device, or ions may be formed within the analyzer volume for example by excitation of a gas by a laser beam. The ions travel within the analyzer volume along a trajectory which comprises a main flight path. As they travel along the main flight path they separate into a train of ions according to their time of flight. For a packet of ions comprising ions of a range of m/z which enter or are formed within the analyzer volume with a similar kinetic energy, the ions will separate according to their m/z, with ions of lower m/z leading ions of higher m/z.

The analyzer field may advantageously be set to the main analyzer field (i.e. the analyzer field in which the charged particles move along the main flight path) at all times, including the times at which ions are injected into the analyzer and ejected from the analyzer. In preferred embodiments the main flight path extends from and to the boundary of the analyzer volume: from a point at which ions enter the analyzer volume, to a point at which ions exit the analyzer volume. Advantageously in these embodiments no additional ion optical devices are required within the analyzer volume, nor are any power supplies connected to the analyzer to be switched to effect entry and exit from the analyzer. Furthermore, no significant distortion of the analyzer field is induced by the entry and exit ports and consequently no field correction electrodes are required within the analyzer to compensate. These advantages reduce the complexity of the analyzer and its build cost. They also reduce the technical difficulties of analyzer control during the processes of injecting ions into the analyzer and ejecting ions from the analyzer since no high speed switching of analyzer power supplies is required.

In some embodiments, ions from an injector such as a pulsed ion source are directed through an aperture in the outer field defining electrode system of one of the mirrors and arrive within the analyzer volume upon the main flight path, travelling in a direction and possessing an energy such that the ions follow the main flight path without further intervention. After a predetermined number of orbits, and whilst still travelling upon the main flight path the separated train of ions reaches the same or a different aperture in the outer field defining electrode system of one of the mirrors and exits the analyzer volume.

The main flight path extends to an exit port. The main flight path may extend from an entry port to an exit port. Preferably the main flight path extends from an entry port to an exit port. In some embodiments the exit port comprises a discrete aperture in the outer field-defining electrode system of one or both the mirrors.

In some embodiments ions are created within the analyzer volume and immediately proceed upon the main flight path. After a predetermined number of orbits, and whilst still travelling upon the main flight path the separated train of ions reaches an exit port and thereafter leaves the analyzer volume.

Advantages of the invention are realised by the utilisation of radial oscillations as well as axial oscillations of the ion beam. The radial and axial oscillation periods are set such that the ion beam is directed to an exit port, which comprises in some embodiments a discrete aperture in the outer field defining electrode system of one of the mirrors.

On passing through the exit port the beam proceeds to exit the analyzer volume. The beam may immediately exit the analyzer volume upon passing through the exit port, or it may travel a further distance within the analyzer volume before leaving the analyzer volume, e.g. the beam may pass through the exit port and pass into an ion optical device located at least partly within the analyzer volume and be transported therethrough before leaving the analyzer volume.

The beam is directed to the exit port after a predetermined number of orbits. Preferably the predetermined number of orbits is greater than two. More preferably the predetermined number of orbits is greater than 5 and less than the limit at which trajectories start to overlap. The limit at which trajectories start to overlap will depend upon the beam divergence characteristics and the parameters of the main flight path, amongst other things. The predetermined number of orbits may comprise an integer number of orbits, or it may comprise an integer number of orbits plus a part orbit.

Radial and/or axial oscillations of the ion beam may be induced by application of one or more beam deflections within the analyzer volume. Alternatively and more preferably, both the radial and axial oscillation periods are set by the trajectory of the ions as they enter the analyzer, or by the location of ions formed within the analyzer volume, together with the strength and form of the analyzer field. This more preferred method has the advantage that no beam deflection apparatus is required within the analyzer volume which could distort the analyzer field.

In a preferred embodiment, where ions are introduced into the analyzer from an external pulsed ion source located outside the analyzer volume, radial oscillations are induced as the ions possess kinetic energy in the direction perpendicular to the analyzer axis which would, in the strength of the analyzer field that has been set, produce a circular orbit of radius R. R lies within the analyzer volume, somewhere between the inner and outer field-defining electrode systems. However, because the ions enter the analyzer volume through an entry port in the outer electrode structure of one of the mirrors, the ions enter at a radius similar to that of the outer field defining electrode systems of the mirror at that position on the analyzer axis and the orbital motion is not circular but is eccentric, i.e. the orbital trajectory possesses radial oscillations. As well as having a component of motion in a direction perpendicular to the analyzer axis so that the ions orbit around the analyzer axis, the ions are injected into the analyzer volume through the entry port with a component of motion in the direction of the analyzer axis, and consequently in a direction towards one of the opposing mirrors. The main flight path thus extends around the analyzer axis and along the analyzer axis in an eccentric helix. The ions penetrate into a first of the opposing mirrors whilst orbiting around the analyzer axis, are turned around in the direction of the analyzer axis by the action of the first mirror, and travel back and towards the other opposing mirror (the second mirror). The ions penetrate the second mirror and are turned back towards the first mirror again. Hence the ions undergo both axial and radial oscillations. The ions undergo a plurality of both axial and radial oscillations. The periods of the axial and radial oscillations are preferably set by the trajectory of the ion beam upon entry to the analyzer and by the strength and form of the analyzer field. These are chosen such that the ion beam undergoes a maximum radial orbital extent at the same time as it reaches an exit port only after a predetermined number of orbits at which time it passes without further intervention through the exit port, and proceeds to leave the analyzer volume.

In other embodiments ions are created within the analyzer volume at locations such that the main analyzer field immediately induces ion motion along the main flight path. Again the main flight path extends around the analyzer axis and along the analyzer axis in an eccentric helix. The ions penetrate into a first of the opposing mirrors whilst orbiting around the analyzer axis, are turned around in the direction of the analyzer axis by the action of the first mirror, and travel back and towards the other opposing mirror (the second mirror). The ions penetrate the second mirror and are turned back towards the first mirror again. Hence the ions undergo both axial and radial oscillations. The ions undergo a plurality of both axial and radial oscillations. The periods of the axial and radial oscillations are preferably set by the location of the creation of the ions and by the strength and form of the analyzer field. These are chosen such that the ion beam undergoes a maximum radial orbital extent at the same time as it reaches an exit port only after a predetermined number of orbits, at which time it passes without further intervention through the exit port, and proceeds to leave the analyzer volume.

The exit port may be the same aperture as the entry port or it may be a different aperture. Where the exit port is a different aperture, the exit port may be formed within the outer field-defining electrode structure of the same mirror as comprises the entry port, or it may be formed within the outer field-defining electrode structure of the opposing mirror.

The exit port and, where used, the entry port, preferably do not lie at the z=0 plane where the mirrors abut unless additional beam deflection apparatus is located within the analyzer. Without beam deflection, a main flight path starting at the inner surface of the outer field-defining electrode at or near the z=0 plane will possess a maximum radial beam envelope such that on oscillating axially, the beam will strike the inner surface of the outer electrode at the next maximum radial oscillation. Preferably the exit port and, where used, the entry port, lie away from the z=0 plane. More preferably the exit port and, where used, the entry port, are at the plane in which the turning point of the ion beam occurs in one or both the mirrors. (The ions have multiple turning points in a given mirror, one for each oscillation in the direction of the analyzer axis, and these turning points lie upon a plane within each mirror, which may be termed the turning plane.) Ions entering the analyzer through the entry port then start upon the main flight path at maximum axial and maximum radial coordinates and oscillate axially and radially with cosine time dependence. If the axial oscillation frequency is $\omega$ and the radial oscillation frequency is $\omega_r$ then when $\omega \cdot t = \pi \cdot n$, $n=1, 2, \ldots$, then the normalised amplitude of radial oscillation as a function of time, $A=\cos(\omega_r \cdot t)=\cos((\omega_r/\omega) \cdot \pi \cdot n)$. The axial and radial oscillation frequencies are chosen so that w and $\omega_r$ are not related as a ratio $(\omega_r/\omega)$ of very small integers (i.e. 2, 3, 4 . . . ) but preferably as a ratio of integers in the range 7-20. This then produces a main flight path that oscillates axially and radially a sufficient number of times to produce a long flight path length but not so long that the main flight path envelope collides with the inner surface of the outer field-defining electrode of one of the mirrors before reaching the exit port.

For example if the ratio $\omega_r/\omega=7/9$, then when n=1, A=−0.766; n=2, A=0.174; n=3, A=0.5; n=4, A=−0.94; n=5, A=0.94; n=6, A=−0.5, n=7, A=−0.174; n=8, A=0.766; n=9, A=−1.0 and the beam reaches the exit port which is in this case located on the opposite side of the analyzer (180 degrees arcuate rotation) from the entry port. The beam approaches the inner surface of the outer field-defining electrode of the mirror when n=4 and n=5, and the ion beam must be sufficiently confined at those points that it does not strike the electrode. Preferably the beam remains at least 1 mm from the electrode surface.

In another example, if the ratio $\omega_r/\omega=10/11$, then when n=1, A=−0.959; n=2, A=0.841; n=3, A=−0.655; n=4, A=0.415; n=5, A=−0.142; n=6, A=−0.142, n=7, A=0.415; n=8, A=−0.655; n=9, A=0.841; n=10, A=−0.959, n=11, A=1 and the beam reaches the exit port which is in this case located on the same side of the analyzer as the entry port and may comprise the same aperture as the entry port.

In other embodiments, the ratio may not be limited to whole integers, in which case the exit port lies some fraction of π radians around the analyzer axis from the entry port.

In alternative embodiments, at least a portion of an injector is inserted into the analyzer volume but electrically shielded therefrom, and ions are injected through an entry port onto the main flight path travelling in a direction and possessing energy such that the ions follow the main flight path without further intervention. After a predetermined number of orbits, and whilst still travelling upon the main flight path the separated train of ions reaches an exit port and passes into a further ion optical device which is inserted into the analyzer volume but electrically shielded therefrom, and the ions are transported out of the analyzer volume. In these embodiments ions thus leave the analyzer volume only if they reach the exit port whilst possessing trajectory within a relatively narrow angular range. This angular range restriction means that for successful exit, the ion beam must possess certain resonance between the axial oscillations, the radial oscillations and the arcuate angular frequency of the beam. Various such resonance conditions will be possible, with varying residence periods within the analyzer. These embodiments are more complex than other embodiments described, but still retain the advantage that no high speed switching of power supplies is required during injection and ejection of ions. They also have the advantage that the maximum radial extent of the beam does not approach the inner surface of the outer field-defining electrode at any time and the total length of the main flight path may be increased by a factor 3-10, typically 3-5.

According to the present invention, in a further independent aspect, there is provided an analyzer for separating ions according to their time of flight comprising:

two opposing ion mirrors abutting at a first plane, each mirror comprising inner and outer field-defining electrode systems elongated along an analyzer axis, the outer field-defining electrode system surrounding the inner field-defining electrode system; wherein: the outer field-defining electrode system of one mirror comprises two sections, the sections abutting at a second plane, comprising a first section between the first plane and the second plane, and a second section adjacent the first section; wherein the first section has at least a portion which extends radially from the analyzer axis a greater extent than an adjacent portion of the second section at the second plane.

In a preferred embodiment the analyzer comprises at least one mirror which has a split outer field-defining electrode structure, the split providing a radial gap through which ions may both enter and exit. The split outer field-defining electrode structure of the at least one mirror comprises two sections which abut at a second plane, with one section extending radially from the analyzer axis a greater extent than an adjacent portion of the second section where the two sections meet, thereby forming a radial gap. The radial gap preferably comprises an exit port. The radial gap more preferably comprises an exit port and an entry port. The radial gap may extend all the way around the analyzer axis or it may extend only partially around the analyzer axis. Where the radial gap extends all the way around the analyzer axis, the first section of the outer field-defining electrode system is of larger diameter than the second section of the outer field-defining electrode system at the second plane. Where the radial gap extends only partially around the analyzer axis, there may be one or a plurality of radial gaps each partially extending around the analyzer axis. Preferably there are radial gaps extending in regions in which ions are to be injected into the analyzer and in regions in which ions are to be ejected from the analyzer, thereby providing entry and exit ports. Both mirrors may comprise split outer field-defining electrode structures. Preferably only one mirror comprises a split outer field-defining electrode structure. The term abut in this context does not necessarily mean that the mirrors or the sections physically touch but means they touch or lie closely adjacent to each other. The two sections abut at a second plane, and there may or may not be a small gap between the sections in the direction of the analyzer axis at the second plane. In use, the first and second sections of the outer field-defining electrode system may have different electrical biases applied.

The opposing mirrors may or may not be asymmetric, i.e. the opposing mirrors may or may not have asymmetric opposing electrical fields. Whilst the size and/or shape of the outer field-defining electrode system of one mirror may differ from that of the opposing mirror, the sizes and shapes of the inner and outer field-defining electrode systems together with the electrical potentials applied may or may not induce asymmetric opposing electrical fields. Preferably the sizes and shapes of the inner and outer field-defining electrode systems together with the electrical potentials applied induce symmetrical opposing electrical fields.

Embodiments of the present invention benefit from one or more of the following advantages: (a) no beam deflection is required upon entry of the ions into the analyzer volume; (b) no beam deflection is required upon exit of the ions from the analyzer volume; (c) the analyzer field may be set and held at the main analyzer field strength at all times during beam entry, m/z separation and exit of ions from the analyzer volume; (d) the residence time of ions within the analyzer may be chosen by selecting beam injection parameters or the ion creation location within the analyzer in order to select the ratio of axial to radial oscillation frequencies; (e) no shielding is required in the vicinity of the entry and/or exit ports to maintain an undistorted analyzer field, (f) simplicity of the overall construction.

The method enables ions to be separated according to their time of flight using an analyzer, the beam of ions being injected into the analyzer or being formed within the analyzer and comprising ions of a plurality of mass to charge ratios. The method may be performed using the analyzer of the present invention.

The two opposing mirrors may be the same or they may be different. Preferably the two opposing mirrors are the same.

In reference to the two opposing mirrors, by the term opposing electrical fields (optionally the electrical fields being substantially linear along z) is meant a pair of charged particle mirrors each of which reflects charged particles towards the other by utilising an electric field, those electric fields preferably being substantially linear in at least the longitudinal (z) direction of the analyzer, i.e. the electric field has a linear dependence on distance in at least the longitudinal (z) direction, the electric field increasing substantially linearly with distance into each mirror. If a first mirror is elongated along a positive direction of the z axis, and a second mirror is elongated along a negative direction of the z axis, the mirrors preferably abutting at or near the plane z=0, the electric field within the first mirror preferably increases linearly with distance into the first mirror in a positive z direction and the electric field within the second mirror preferably increases linearly with distance into the second mirror in a negative z direction. Thus, the opposing electrical fields of the opposing mirrors are oriented in opposite directions. These fields are generated by the application of potentials (electrical bias) to the field-defining electrode systems of the mirrors, which preferably create parabolic potential distributions within each mirror. The opposing electric fields together form an analyzer field. The analyzer field is thus the electric field within the analyzer volume between the inner and outer field-defining electrode systems, which is created by the application of potentials to the field-defining electrode systems of the mirrors. The analyzer field is described in more detail below. The electric field within each mirror may be substantially linear along z within only a portion of each mirror. Preferably the electric field within each mirror is substantially linear along z within the whole of each mirror. The opposing mirrors may be spaced apart from one another by a region in which the electric field is not linear along z. In some preferred embodiments there may be a located in this region, i.e. where the electric field is not linear along z, one or more belt electrode assemblies as further described herein. Preferably any such region is shorter in length along z than ⅓ of the distance between the maximum turning points of the charged particle beam within the two mirrors. Preferably, the charged particles fly in the analyzer volume with a constant velocity along z for less than half of the overall time of their oscillation, the time of oscillation being the time it takes for the particles to reach the same point along z after reflecting once from each mirror.

Preferably the opposing mirrors abut directly so as to be joined at or near the plane z=0. Within the analyzer there may be additional electrodes serving further functions, examples of which will be described below, for instance belt electrode assemblies. Such additional electrodes may be within one or both of the opposing mirrors.

In preferred embodiments, the opposing mirrors are substantially symmetrical about the z=0 plane. In other embodiments, the opposing mirrors may not be symmetrical about the z=0 plane. Each mirror comprises inner and outer field-defining electrode systems elongated along a respective mirror axis, the outer system surrounding the inner, each system comprising one or more electrodes. In operation, the charged particles in the beam orbit around one or more of the inner field-defining electrode systems within each respective mirror whilst travelling within each respective mirror, travelling within the analyzer volume between the inner and outer field-defining electrode systems as they do so. The orbital motion of the beam is an eccentric helical motion orbiting around the analyzer axis z whilst travelling from one mirror to the other in a direction parallel to the z axis. The orbital motion around the analyzer axis z is in some embodiments substantially elliptical whilst in other embodiments it is of a different shape. The orbital motion around one or more of the inner field-defining electrode systems may vary according to the distance from the z=0 plane.

The mirror axes are generally aligned with the analyzer axis z. The mirror axes may be aligned with each other, or a degree of misalignment may be introduced. The misalignment may take the form of a displacement between the axes of the mirrors, the axes being parallel, or it may take the form of an angular rotation of one of the mirror axes with respect to the other, or both displacement and rotation. Preferably the mirrors axes are substantially aligned along the same longitudinal axis and preferably this longitudinal axis is substantially co-axial with the analyzer axis. Preferably the mirror axes are co-axial with the analyzer axis z.

The field-defining electrode systems may be a variety of shapes as will be further described below. Preferably the field-defining electrode systems are of shapes that produce a quadro-logarithmic potential distribution within the mirrors; but other potential distributions are contemplated and will be further described.

The inner and outer field-defining electrode systems of a mirror may be of different shapes. Preferably the inner and outer field-defining electrode systems are of a related shape, as will be further described. More preferably both the inner and outer field-defining electrode systems of each mirror each have a circular transverse cross section (i.e. transverse to the analyzer axis z). However, the inner and outer field-defining electrode systems may have other cross sections than circular such as elliptical, hyperbolic as well as others. The inner and outer field-defining electrode systems may or may not be concentric. In some preferred embodiments the inner and outer field-defining electrode systems are concentric. The inner and outer field-defining electrode systems of both mirrors are preferably substantially rotationally symmetric about the analyzer axis.

One of the mirrors may be of a different form to the other mirror, in one or more of: the form of its construction, its shape, its dimensions, the matching of the forms of the shapes between inner and outer electrode systems, the concentricity between the inner and outer electrode systems, the electrical potentials applied to the inner and/or outer field-defining electrode systems or other ways. Where the mirrors are of a different form to each other the mirrors may produce opposing electrical fields which are different from each other or the mirrors may produce opposing electrical fields which are substantially the same as each other. In some embodiments whilst the mirrors are of different construction and/or have different electrical potentials applied to the field-defining electrode systems, the electric fields produced within the two mirrors are substantially the same. In some embodiments the mirrors are substantially identical and have a first set of one or more electrical potentials applied to the inner field-defining electrode systems of both mirrors and a second set of one or more electrical potentials applied to the outer field-defining electrode systems of both mirrors. In other embodiments the mirrors differ in prescribed ways, or have differing potentials applied, in order to create asymmetry (i.e. different opposing electrical fields), which provides additional advantages.

A field-defining electrode system of a mirror may consist of a single electrode, for example as described in U.S. Pat. No. 5,886,346, or a plurality of electrodes (e.g. a few or many electrodes), for example as described in WO 2007/000587. The inner electrode system of either or both mirrors may for example be a single electrode, as may the outer electrode system. Alternatively a plurality of electrodes may be used to form the inner and/or outer electrode systems of either or both mirrors. Preferably the field-defining electrode systems of a mirror consist of single electrodes for each of the inner and outer electrode systems. In some preferred embodiments the outer field-defining electrode system of one or both of the mirrors is split into at least two sections. The surfaces of the inner and outer electrode systems will constitute equipotential surfaces of the electrical fields.

The outer field-defining electrode system of each mirror is of greater size than the inner field-defining electrode system and is located around the inner field-defining electrode system. As in the Orbitrap™ electrostatic trap, the inner field-defining electrode system is preferably of spindle-like form, more preferably with an increasing diameter towards the mid-point between the mirrors (i.e. towards the equator (or z=0 plane) of the analyzer), and the outer field-defining electrode system is preferably of barrel-like form, more preferably with an increasing diameter towards the mid-point between the mirrors. (The Orbitrap™ is described, for example, in U.S. Pat. No. 5,886,346.) This preferred form of analyzer construction advantageously uses fewer electrodes and forms an electric field having a higher degree of linearity than many other forms of construction. In particular, forming parabolic potential distributions in the direction of the mirror axes within the mirrors with the use of electrodes shaped to match the parabolic potential near the axial extremes produces a desired linear electric field to higher precision near the locations at which the charged particles reach their turning points and are travelling most slowly. Greater field accuracy at these regions provides a higher degree of time focusing, allowing higher mass RP to be obtained. Where the inner field defining electrode system of a mirror comprises a plurality of electrodes, the plurality of electrodes is preferably operable to mimic a single electrode of spindle-like form. Similarly, where the outer field defining electrode system of a mirror comprises a plurality of electrodes, the plurality of electrodes is preferably operable to mimic a single electrode of barrel-like form.

The inner field-defining electrode systems of each mirror are preferably of increasing diameter towards the mid-point between the mirrors (i.e. towards the equator (or z=0 plane) of the analyzer. The inner field-defining electrode systems of each mirror may be separate electrode systems from each other separated by an electrically insulating gap or, alternatively, a single inner field-defining electrode system may constitute the inner field-defining electrode systems of both mirrors (e.g. as in the Orbitrap™ electrostatic trap). The single inner field-defining electrode system may be a single piece inner field-defining electrode system or two inner field-defining electrode systems in electrical contact. The single inner field-defining electrode system is preferably of spindle-like form, more preferably with an increasing diameter towards the mid-point between the mirrors. Similarly, the outer field-defining electrode systems of each mirror are preferably of increasing diameter towards the mid-point between the mirrors. The outer field-defining electrode systems of each mirror may be separate electrodes from each other separated by an electrically insulating gap or, alternatively, a single outer field-defining electrode system may constitute the outer field-defining electrode systems of both mirrors. The single outer field-defining electrode system may be a single piece outer electrode or two outer electrodes in electrical contact. The single outer field-defining electrode system is preferably of barrel-like form, more preferably with an increasing diameter towards the mid-point between the mirrors.

Preferably, the two mirrors abut near, more preferably at, the z=0 plane to define a continuous equipotential surface. The term abut in this context does not necessarily mean that the mirrors physically touch but means they touch or lie closely adjacent to each other. Accordingly, in some preferred embodiments the charged particles preferably undergo simple harmonic motion in the longitudinal direction of the analyzer which is perfect or near perfect.

In one embodiment, a quadro-logarithmic potential distribution is created within the analyzer. The quadro-logarithmic potential is preferably generated by electrically biasing the two field-defining electrode systems. The inner and outer field-defining electrode systems are preferably shaped such that when they are electrically biased a quadro-logarithmic potential is generated between them. The total potential distribution within each mirror is preferably a quadro-logarithmic potential, wherein the potential has a quadratic (i.e. parabolic) dependence on distance in the direction of the analyzer axis z (which is the longitudinal axis) and has a logarithmic dependence on distance in the radial (r) direction. In other embodiments, the shapes of the field-defining electrode systems are such that no logarithmic potential term is generated in the radial direction and other mathematical forms describe the radial potential distribution.

As used herein, the terms radial, radially refer to the cylindrical coordinate r. In some embodiments, the field-defining electrode systems of the analyzer do not posses cylindrical symmetry, as for example when the cross sectional profile in a plane at constant z is an ellipse, and the terms radial, radially if used in conjunction with such embodiments do not imply a limitation to only cylindrically symmetric geometries.

In some embodiments the analyzer electrical field is not necessarily linear in the direction of the analyzer axis z but in preferred embodiments is linear along at least a portion of the length along z of the analyzer volume.

All embodiments of the present invention have several advantages over many prior art multi-reflecting systems. The presence of one or more inner field-defining electrode systems serves to shield charged particles on one side of the system from the charge present on particles on the other side, reducing the effects of space charge on the train of packets. In addition, axial spreading of the beam (i.e. spreading in the direction of the analyzer axis z) due to any remaining space charge influence does not change significantly the time of flight of the particles in an axial direction—the direction of time of flight separation.

In preferred embodiments utilising opposing linear electric fields in the direction of the analyzer axis, the charged particles are at all times whilst upon the main flight path travelling with speeds which are not close to zero and which are a substantial fraction of the maximum speed. In such embodiments, the charged particles are also never sharply focused except in some embodiments where they are focused only upon commencing the main flight path. Both these features thereby further reduce the effects of space charge upon the beam. The undesirable effect of self-bunching of charged particles may also be avoided by the introduction of very small field non-linearities, as described in WO06129109.

In preferred embodiments, the invention utilises a quadro-logarithmic potential concentric electrode structure as used in an Orbitrap™ electrostatic trap, in the form of a TOF separator. In principle, both perfect angular and energy time focusing is achieved by such a structure.

An additional fundamental problem with prior art folded path reflecting arrangements utilising parabolic potential reflectors is that the parabolic potential reflectors cannot be abutted directly to one another without distorting the linear field of the reflectors to some extent, which has generally led to the introduction of a relatively long portion of relatively field free drift space between the reflectors. Furthermore, in the prior art the use of linear fields (parabolic potentials) in reflectors leads to the charged particles being unstable in a perpendicular direction to their travel. To compensate for this the prior art has used a combination of a field free region, a strong lens and a uniform field. Either the distortion and/or the presence of field free regions makes perfect harmonic motion impossible with such prior art parabolic potential reflectors. To obtain a high degree of time focusing at the detector, the field within one or more of the reflectors must be changed to try and compensate for this, or some additional ion optical component must be introduced into the flight path. In contrast to the mirrors of some embodiments of the present invention, perfect angular and energy focusing cannot be achieved with these multi-reflection arrangements.

A preferred quadro-logarithmic potential distribution U(r, z) formed in each mirror is described in equation (1):

$$U(r, z) = \frac{k}{2}\left(z^2 - \frac{r^2}{2}\right) + \frac{k}{2}(R_m)^2 \ln\left[\frac{r}{R_m}\right] + C \tag{1}$$

where r,z are cylindrical coordinates (r=radial coordinate; z=longitudinal or axial coordinate), C is a constant, k is field linearity coefficient and $R_m$ is the characteristic radius. The latter has also a physical meaning: the radial force is directed towards the analyzer axis for $r<R_m$, and away from it for $r>R_m$, while at $r=R_m$ it equals 0. Radial force is directed towards the axis at $r<R_m$. In preferred embodiments $R_m$ is at a greater radius than the outer field-defining electrode systems of the mirrors, so that charged particles travelling in the space between the inner and outer field-defining electrode systems always experience an inward radial force, towards the inner field-defining electrode systems. This inward force balances the centripetal force of the orbiting particles.

When ions are moving on a circular spiral of radius R in such a potential distribution, their motion could be described by three characteristic frequencies of oscillation of charged particles in the potential of equation (1): axial oscillation in the z direction given in equations (2) by ω, orbital frequency of oscillation (hereinafter termed angular oscillation) around the inner field-defining electrode system in what is herein termed the arcuate direction (ϕ) given in equations (2) by $\omega_\Phi$ and radial oscillation in the r direction given in equations (2) by $\omega_r$.

$$\omega = \sqrt{\frac{e}{(m/z)} \cdot k} \qquad \omega_\phi = \omega \cdot \sqrt{\frac{\left(\frac{R_m}{R}\right)^2 - 1}{2}} \tag{2}$$

$$\omega_r = \omega \cdot \sqrt{\left(\frac{R_m}{R}\right)^2 - 2}$$

where e is the elementary charge, m is the mass and z is the charge of the charged particles, and R is the initial radius of the charged particles. The radial motion is stable if $R<R_m/2^{1/2}$ therefore $\omega_\Phi>\omega/2^{1/2}$, and for each reflection (i.e. change of axial oscillation phase by π), the trajectory must rotate by more than $\pi/(2)^{1/2}$ radian. A similar limitation is present for potential distributions deviating from (1) and represents a significant difference from all other types of known ion mirrors.

The equations (2) show that the axial oscillation frequency is independent of initial position and energy and that both rotational and radial oscillation frequencies are dependent on initial radius, R. Further description of the characteristics of this type of quadro-logarithmic potential are given by, for example, A. Makarov, Anal. Chem. 2000, 72, 1156-1162.

Whilst a preferred embodiment utilises a potential distribution as defined by equation (1), other embodiments of the present invention need not. Embodiments utilising the opposing linear electric fields in the direction of the analyzer (longitudinal) axis can use any of the general forms described by equations (3a) and (3b) in (x,y) coordinates, the equations also given in WO06129109.

$$U_g(x, y, z) = U(r, z) + W(x, y) \tag{3a}$$

$$W(x, y) = -\frac{k}{4}[x^2 - y^2]a + \left[A.r^m + \frac{B}{r^m}\right]\cos\left\{m.\cos^{-1}\left(\frac{x}{r}\right) + \alpha\right\} + b \cdot \ln\left(\frac{r}{D}\right) + E \cdot \exp(F \cdot x)\cos(F \cdot y + \beta) + G \cdot \exp(H \cdot y)\cos(H \cdot x + \gamma) \tag{3b}$$

where $r=\sqrt{(x^2+y^2)}$; α,β, γ, a, A, B, D, E, F, G, H are arbitrary constants (D>0), and j is an integer. Equations (3a) and (3b) are general enough to remove completely any or all of the terms in Equation (1) that depend upon r, and replace them with other terms, including expressions in other coordinate systems (such as elliptic, hyperbolic, etc.). For a particle starting and ending its path at z=0, the time-of-flight in the potential described by equations (3a) and 3(b) corresponds to one half of an axial oscillation:

$$T = \frac{\pi}{\omega} = \pi\sqrt{\frac{(m/z)}{ek}} \tag{4}$$

The coordinate of the turning point is $z_{tp}=v_z/\omega$ where $v_z$ is axial component of velocity at z=0 and equivalent path length over one half of axial oscillation (i.e. single reflection) is $v_zT=\pi \cdot z_{tp}$. The equivalent or effective path length is therefore longer than the actual axial path length by a factor π and is a measure representative of the path length over which time of flight separation occurs. This enhancement by the factor π is due to the deceleration of the charged particles in the axial direction as they penetrate further into each of the mirrors. In the present invention the preferred absence of any significant length of field-free region in the axial direction produces this large enhancement and is an additional advantage over reflecting TOF analyzers that utilize extended field-free regions.

The beam of charged particles flies through the analyzer along a main flight path. The main flight path preferably comprises a reflected flight path between the two opposing mirrors. The main flight path of the beam between the two opposing mirrors lies in the analyzer volume, i.e. between the inner and outer field-defining electrode systems. The two directly opposing mirrors in use define a main flight path for the charged particles to take as they undergo at least one full oscillation of motion in the direction of the analyzer (z) axis between the mirrors. As the beam of charged particles flies through the analyzer along the main flight path it preferably undergoes at least one full oscillation of substantially simple harmonic motion along the longitudinal (z) axis of the analyzer whilst orbiting around the analyzer axis (i.e. rotation in the arcuate direction). As used herein, the term angle of orbital motion refers to the angle subtended in the arcuate direction as the orbit progresses. Accordingly, a preferred motion of the beam along its flight path within the analyzer is a helical motion around the inner field-defining electrode system. As already described, in the present invention the main flight path is preferably an eccentric helix. In preferred embodiments the ratio of the radial oscillation frequency to the axial oscillation frequency $\omega_r/\omega$ lies between one or more of the ranges: 0.5 and 3, 0.6 and 2.5, 0.7 and 2.0, 0.8 and 1.7, and more preferably between 0.85 and 1.2.

Additional embodiments of the invention utilise two opposing mirrors with the analyzer field generated within the analyzer volume by the application of potentials to electrode structures comprising two opposing outer field-defining electrode systems and two opposing inner field-defining electrode systems, wherein the inner field-defining electrode systems comprise a plurality of spindle-like electrode structures extending within the outer field-defining electrode systems. Each of the plurality of spindle-like structures extends substantially parallel to the z axis. In common with previously described embodiments, the field in the z direction is substantially linear and ion motion along the main flight path in the z direction is substantially simple harmonic. Ion motion orthogonal to the z direction may take a variety of forms, including orbiting around one or more of the inner field-defining electrode spindle structures. The term orbiting around includes orbiting successively around each of a plurality of the inner field-defining electrode spindle structures one or more times and it also includes orbiting around a plurality of the inner field-defining electrode spindle structures in each orbit, i.e. each orbit encompasses more than one of the inner field-defining electrode spindle structures.

The above embodiments are particular solutions to the general equation $$U(x, y, z) = \frac{k}{2} \cdot z^2 + V(x, y) \tag{5a}$$

where k has the same sign as ion charge (e.g. k is positive for positive ions) and $$\Delta V(x, y) = -\frac{k}{2}. \tag{5b}$$

Specifically, solutions include $$U(x, y, z) = \sum_{i=1}^{N} A_i \cdot \ln(f_i(x, y)) + \frac{k}{2} \cdot (z^2 - (1-\alpha) \cdot x^2 - \alpha \cdot y^2) + W(x, y) \tag{6a}$$

where $$W(x, y) = \left(B \cdot r^m + \frac{D}{r^m}\right) \cdot \cos\left(m \cdot \cos^{-1}\left(\frac{x}{r}\right) + \alpha\right) + E \cdot \exp(F \cdot x) \cdot \cos(F \cdot y + \beta) + G \cdot \exp(H \cdot y) \cdot \cos(H \cdot x + \gamma) + C \tag{6b}$$

and where $A_i$, B, C, D, E, F, G, H are real constants and each $f_i(x, y)$ satisfies $$f(x, y) = \frac{\left(\frac{d}{dx}(f(x, y))\right)^2 + \left(\frac{d}{dy}(f(x, y))\right)^2}{\frac{d^2}{dx^2}(f(x, y)) + \frac{d^2}{dy^2}(f(x, y))}. \tag{6c}$$

A particular solution being $$f(x,y) = (x^2+y^2)^2 - 2b^2(x^2-y^2) + b^4 \tag{6d}$$

where b is a constant (C. Köster, Int. J. Mass Spectrom. Volume 287, Issues 1-3, pages 114-118 (2009)).

Equations (6a-*c*) with the particular solution (6d) are satisfied by two opposing mirrors each mirror comprising inner and outer field-defining electrode systems elongated along an axis z, each system comprising one or more electrodes, the outer system surrounding the inner. The inner field-defining electrode systems each comprise one or more electrodes. The one or more electrodes include spindle-like structures extending substantially parallel to the z axis. Each spindle-like structure may itself comprise one or more electrodes. One of the spindle-like structures may be on the z axis. Additionally or alternatively, two or more of the spindle-like structures may be off the z axis, typically disposed symmetrically about the z axis.

The analyzer may further comprise one or more arcuate focusing lenses, which will be further described. These lenses constrain the angular divergence of the ions in the arcuate direction. Where there is a plurality of arcuate focusing lenses and where those lenses are located at or near the z=0 plane, preferably, the beam position advances at the lens location by a distance in the arcuate direction after a given number of reflections from the mirrors (e.g. one or two reflections). In this way, the beam flies along the main flight path through the analyzer back and forth along the analyzer axis in a path which steps around the analyzer axis (i.e. in the arcuate direction) in the z=0 plane so as to intercept arcuate focusing lenses adjacent the main flight path. The orbiting motion may have an elliptic or other form of cross sectional shape.

In other preferred embodiments, the beam orbits around the inner field-defining electrode system of each mirror and thereby around the analyzer axis z once per reflection and intercepts a single arcuate focusing lens.

A characteristic feature of some preferred embodiments is that the main flight path orbits around the inner field-defining electrode system approximately once or more than once whilst performing a single oscillation in the direction of the analyzer axis. This has the advantageous effect of separating the charged particle beam around the inner field-defining electrode system, reducing the space charge effects of one part of the beam from another, as described earlier. Another advantage is that the strong effective radial potential enforces strong radial focusing of the beam and hence provides a small radial size of the beam. This in turn increases resolving power of the apparatus due to a smaller relative size of the beam and a smaller change of perturbing potentials across the beam. Preferably the ratio of the frequency of the orbital motion to that of the oscillation frequency in the direction of the longitudinal axis z of the analyzer is between 0.71 and 5. More preferably the ratio of the frequency of the orbital motion to that of the oscillation frequency in the direction of the longitudinal axis of the analyzer is between (in order of increasing preference) 0.8 and 4.5, 1.2 and 3.5, 1.8 and 2.5. Some preferred ranges therefore include 0.8 to 1.2, 1.8 to 2.2, 2.5 to 3.5 and 3.5 to 4.5.

As the charged particles travel along the main flight path of the analyzer, they are separated according to their mass to charge ratio (m/z). The degree of separation depends upon the flight path length in the direction of the analyzer axis z, amongst other things. Having been separated, the train of separated ions leaves the analyzer through the exit port and subsequently one or more ranges of m/z may be selected from the train for further processing using an ion gate. The term a range of m/z includes herein a range so narrow as to include only one resolved species of m/z.

In prior art analyzers having potential distributions described by equation (3) and other types of analyzers, such as the quadro-logarithmic potential distribution, divergence in r is constrained, and arcuate divergence is not constrained at all. Strong radial focusing is achieved automatically in the quadro-logarithmic potential when ions are moving on trajectories which follow either a circular helix or an eccentric helix, but the unconstrained arcuate divergence of the beam would, if unchecked, lead to a problem of complete overlapping of trajectories for ions of the same m/z but different initial parameters. Injected charged particles would, as in the Orbitrap™ electrostatic trap, form rings around the inner field-defining electrode system, the rings comprising ions of the same m/z, the rings oscillating in the longitudinal analyzer axial direction. In the Orbitrap™ electrostatic trap, image current detection of ions within the trap is unaffected. However, for use of such a field for time of flight separation and selection of charged particles, a portion of the beam must be selectively ejected from the device for detection or further processing. Some form of ejection mechanism must be introduced into the beam path to eject the beam from the field to a detector. Any ejection mechanism within the analysing field would have to act upon all the ions in the ring if it were to eject or detect all the charged particles of the same m/z present within the analyzer. This task is impractical as the various rings of charged particles having differing m/z oscillate at different frequencies in the longitudinal direction of the analyzer, and rings of different m/z may overlap at any given time. Even if the beam is ejected or detected before it forms a set of full rings of different m/z particles, during the flight path the initial packet of charged particles becomes a train of packets, lower m/z particles preceding higher m/z particles. Packets of charged particles at the front of the train that have diverged arcuately, spreading out around the inner field-defining electrode system, could overlap packets further back in the train. If charged particles are to be separated by their flight time and a subset selected by ejecting them from the analyzer to a receiver, the selection process would undesirably select ions having undergone widely differing flight times, as overlapping charged particles from different sections of the train would be ejected.

The present invention may be employed with ion beams that have limited divergence in the arcuate direction and which remain within the analyzer for only a limited time such that trajectories do not overlap. However, where the train of ions has sufficient divergence in the arcuate direction and remains within the analyzer for sufficient time that overlapping of trajectories would result, the present invention addresses this problem by introducing arcuate focusing, i.e. focusing of the charged particle packets of desired ions in the arcuate direction so as to constrain their divergence in that direction. The term arcuate is used herein to mean the angular direction around the longitudinal analyzer axis z. FIG. 1 shows the respective directions of the analyzer axis z, the radial direction r and the arcuate direction ø, which thus can be seen as cylindrical coordinates.

Analyzers comprising two opposing ion mirrors each mirror comprising inner and outer field-defining electrode systems elongated along an analyzer axis z are described in the applicant's pending patent applications PCT/EP2010/057340 and PCT/EP2010/057342, the entire contents of which are hereby incorporated by reference.

Arcuate focusing confines the beam so that the ions of interest remain sufficiently localised in their spread around the analyzer axis z (i.e. in the arcuate direction) that they may be ejected successfully. With such arcuate focusing the preferred quadro-logarithmic potential of the present invention can be utilised successfully with large numbers of multiple reflections to give a high mass resolution TOF analyzer for m/z selection, optionally having unlimited mass range. Arcuate focusing may also be employed in orbital analyzers having other forms of potential distributions.

The term arcuate focusing lens (or simply arcuate lens) is herein used to describe any device which provides a field that acts upon the charged particles in the arcuate direction, the field acting to reduce beam divergence in the arcuate direction. The term focusing in this context is not meant to imply that any form of beam crossover is necessarily formed, nor that a beam waist is necessarily formed. The lens may act upon the charged particles in other directions as well as the arcuate direction. Preferably the lens acts upon the charged particles in substantially only the arcuate direction. The field provided by the arcuate lens is an electric field. It can be seen therefore, that the arcuate lens may be any device that creates a perturbation to the analyzer field that would otherwise exist in the absence of the lens. In preferred embodiments the analyzer comprises one or more sets of electrodes which when energised produce three-dimensional perturbations to the electric field within one or both the ion mirrors so as to induce arcuate focusing of ions when they pass through the perturbed electric field. The lens may include additional electrodes added to the analyzer, or it may comprise changes to the shapes of the inner and outer field-defining electrode systems. In one embodiment the lens comprises locally-modified inner field-defining electrode systems of one or both of the mirrors, e.g. an inner field-defining electrode system with a locally-modified surface profile. In some embodiments the lens consists of a single electrode adjacent the main flight path. In some embodiments the lens comprises a pair of opposed electrodes, one either side of the main flight path at different distance from the analyzer axis z. The pair of opposed electrodes may be constructed having various shapes, e.g. substantially circular in shape. In some embodiments comprising a plurality of sets of electrodes adjacent the main flight path, neighbouring electrodes may be merged into a single-piece lens electrode assembly which is opposed by another single-piece lens electrode assembly located at a different distance from the analyzer axis on the other side of the beam. That is, a pair of single-piece lens electrode assemblies may be utilised which are shaped to provided a plurality of lenses. A plurality of lenses are thus provided by a single-piece lens electrode assembly which is opposed by another single-piece lens electrode assembly at a different distance from the analyzer axis, the single-piece lens electrode assemblies being shaped to provide a plurality of arcuate focusing lenses. The single-piece lens electrode assemblies preferably have edges comprising a plurality of smooth arc shapes. The single-piece lens electrode assemblies preferably extend at least partially, more preferably substantially, around the z axis in the arcuate direction.

The one or more arcuate lenses are located in the analyzer volume. The analyzer volume is the volume between the inner and outer field-defining electrode systems of the two mirrors. The analyzer volume does not extend to any volume within the inner field-defining electrode systems, nor to any volume outside the inner surface of the outer field-defining electrode systems.

The one or more arcuate lenses may be located anywhere within the analyzer upon or near the main flight path such that in operation the one or more lenses act upon the charged particles as they pass. In preferred embodiments the one or more arcuate lenses are located at approximately the mid-point between the two mirrors (i.e. mid-point along the analyzer axis z). The mid-point between the two mirrors along the z axis of the analyzer, i.e. the point of minimum absolute field strength in the direction of the z axis, is herein termed the equator or equatorial position of the analyzer. The equator is then also the location of the z=0 plane. In a more preferred embodiment the one or more arcuate lenses are placed adjacent one or both of the maximum turning points of the mirrors (i.e. the points of maximum travel along z). In other embodiments, the one or more arcuate lenses are located offset from the mid-point between the two mirrors (i.e. mid-point along the analyzer axis z) but still near the mid-point as described in more detail below.

The one or more arcuate lenses act upon the charged particles as they travel along the main flight path between the inner and outer field-defining electrode systems.

The one or more arcuate lenses may be supported upon the inner and/or outer field-defining electrode systems, upon additional supports, or upon a combination of the two.

The arcuate focusing is preferably performed on the beam at intervals along the flight path. The intervals may be regular (i.e. periodic) or irregular.

The arcuate focusing is more preferably periodic arcuate focusing. In other words, the arcuate focusing is more preferably performed on the beam at regular arcuate positions along the flight path.

The arcuate focusing is preferably achieved by one or more lenses which preferably are placed within the analyzer volume between the inner and outer field-defining electrode systems, i.e. which generate the, e.g. quadro-logarithmic, potentials. Preferably the one or more lenses are located near the turning point of the ion beam in one or both the mirrors. Where there is more than one lens, the plurality of lenses may extend completely around the analyzer axis z or may extend partially around the analyzer axis. In embodiments in which the mirrors are substantially concentric with the analyzer axis, the one or more lenses are preferably also substantially concentric with the analyzer axis.

The one or more lenses may each be centred on or near the z=0 plane. This is because at this plane the axial force on the particles is zero, the z component of the electric field being zero, and in some preferred embodiments the presence of any lenses least disturbs the parabolic potential in the z direction elsewhere in the analyzer, introducing fewest aberrations to the time focusing.

In a more preferred embodiment the one or more lenses may be located close to one or both of the turning points within the analyzer. In this case whilst the z component of the electric field is at its highest value on the flight path, the charged particles are travelling with the least kinetic energy on the flight path and lower focusing potentials are required to be applied to the arcuate lenses to achieve the desired constrainment of arcuate divergence. Furthermore in this location the lenses may be outside the beam envelope simplifying the construction and avoiding any possible collision of ions with the arcuate lenses due to the radial oscillation of the ion motion.

Preferably, where there is more than one arcuate focusing lens the arcuate focusing lenses are periodically placed around the analyzer axis, i.e. regularly spaced around the analyzer axis, in the arcuate direction, i.e. as an array of arcuate focusing lenses. Preferably, the arcuate focusing lenses in the array are located at substantially the same z coordinate. The array of arcuate focusing lenses preferably extends around the z axis in the arcuate direction. As described above, near the equator (or near z=0 plane) the beam position preferably advances by an angle or distance in the arcuate direction after a given number of reflections (e.g. one or two reflections) from the mirrors (one full oscillation along z comprises two reflections). In a similar manner the beam position also advances around the analyzer axis by an angle or distance in the arcuate direction at the turning point of the ions within each mirror (i.e. at maximum z). The arcuate focusing lenses are preferably periodically placed around the analyzer axis of the analyzer and spaced apart in the arcuate direction by a distance substantially equal to the distance in the arcuate direction that the beam advances after the given number of reflections from the parabolic mirrors.

In some embodiments the plurality of arcuate focusing lenses form an array of arcuate focusing lenses located at substantially the same z coordinate, which preferably is at or near z=0 but more preferably is offset from (but near) z=0. The offset z coordinate is preferably where the main flight path crosses over itself during an oscillation, which offset z coordinate is near the z=0 plane. The latter arrangement has the advantage that each arcuate focusing lens can be used to focus the beam twice, i.e. after reflection from one mirror and then after the next reflection from the other mirror as described in more detail below. Utilising each lens twice can therefore be achieved using identical mirrors by offsetting the location of the arcuate focusing lenses from the z=0 plane to the z coordinate where the main flight path crosses over itself during an oscillation. The lenses are thus preferably spaced apart in the arcuate direction by the distance that the beam advances in the arcuate direction at the z coordinate at which the lenses are placed after each oscillation along z.

Unlike other multi-reflection or multi-deflection TOFs, there is substantially no field-free drift space (most preferably no field-free drift space) at all as the arcuate lenses are integrated within the analyzer field produced by the opposing mirrors, and at no point does the electric analyzer field approach zero. Even where there is no axial field, there is a field in the radial direction present. In addition, the charged particles turn about the analyzer axis, and/or about one or more of the inner field-defining electrode systems per each reflection by an angle which is typically much higher (up to tens of times) than the periodicity of the arcuate lenses. In the analyzer of the invention, a substantial axial field (i.e. the field in the z direction) is present throughout the majority of the axial length (preferably two thirds or more) of the analyzer. More preferably, a substantial axial field is present throughout 80% or more, even more preferably 90% or more, of the axial length of the analyzer. The term substantial axial field herein means more than 1%, preferably more than 5% and more preferably more than 10% of the strength of the axial field at the maximum turning point in the analyzer.

In preferred embodiments utilising the quadro logarithmic potential described by equation (1), at the z=0 plane the potential in the radial direction (r) can be approximated by the potential between a pair of concentric cylinders. For this reason, in one type of preferred embodiment, one or more belt electrode assemblies are used, e.g. to support the one or more arcuate focusing lenses or to help to shield the main flight path from voltages applied to other electronic components (e.g. arcuate lens electrodes, accelerators, deflectors, detectors etc.) which may be located within the analyzer volume between the inner and outer field-defining electrode systems or for other purposes. A belt electrode assembly herein is preferably a belt-shaped electrode assembly or a disc-shaped electrode assembly with an axial aperture located in the analyzer volume although it need not extend completely around the inner field-defining electrode systems of the one or both mirrors, i.e. it need not extend completely around the z axis. Thus, a belt electrode assembly extends at least partially around the inner field-defining electrode systems of the one or both mirrors, i.e. at least partially around the z axis, more preferably substantially around the z axis. The belt electrode assembly preferably extends in an arcuate direction around the z axis. The one or more belt electrode assemblies may be concentric with the analyzer axis. The one or more belt electrode assemblies may be concentric with the inner and outer field-defining electrode systems of one or both mirrors. In a preferred embodiment the one or more belt electrode assemblies are concentric with both the analyzer axis and the inner and outer field-defining electrode systems of both mirrors. In some embodiments, the one or more belt electrode assemblies comprise annular belts located between the inner and outer field-defining electrode systems of one or both mirrors, at or near the z=0 plane. In other, more preferred embodiments, a belt electrode assembly may take the form of a ring located near the maximum turning point of the charged particle beam within one of the mirrors. In some embodiments, it may not be necessary for the belt electrode assemblies to extend completely around the inner field-defining electrode systems of the one or both mirrors, e.g. where there are a small number of arcuate focusing lenses, e.g. one or two arcuate focusing lenses. In use, the belt electrode assemblies function as electrodes to approximate the analyzer field (e.g. quadro-logarithmic field), preferably in the vicinity of the z=0 plane, and have a suitable potential applied to them. The presence of belt electrode assemblies may distort the electric field near the z=0 plane. Use of belt electrode assemblies having profiles to follow the equipotential field lines within the analyzer (e.g. quadro-logarithmic shapes in analyzers of having quadro-logarithmic potential distributions) would remove this field distortion near the z=0 plane. However the presence of any energized lens or deflection electrodes situated upon the belt electrode assemblies would also distort the electrical field along z to some extent in the region of the belt electrode assemblies.

The one or more belt electrode assemblies may be supported and spaced apart from the inner and/or outer field-defining electrode systems, e.g. by means of electrically insulating supports (i.e. such that the belt electrode assemblies are electrically insulated from the inner and/or outer field-defining electrode systems). The electrically insulating supports may comprise additional conductive elements appropriately electrically biased in order to approximate the potential in the region around them. The outer field-defining electrode system of one or both mirrors may be waisted-in at and/or near the z=0 plane to support the outer belt electrode assembly.

The belt electrode assemblies are electrically insulated from the arcuate focusing lenses which they may support. Preferably, the belt electrode assemblies extend beyond the edges of the arcuate focusing lenses in the z direction in order to shield the remainder of the analyzer from the potentials applied to the lenses.

The one or more belt electrode assemblies may be of any suitable shape, e.g. the belts may be in the form of cylinders, preferably concentric cylinders. Preferably, the belt electrode assemblies are in the form of concentric cylinder electrodes. More preferably, the one or more belt electrode assemblies may be in the form of sections having a shape which substantially follows or approximates the equipotentials of the analyzer field at the place the belt electrode assemblies are located. As a more preferred example, the belt electrode assemblies may be in the form of quadro-logarithmic sections, i.e. their shape may follow or approximate the equipotentials of the quadro-logarithmic field (i.e. the undistorted quadro-logarithmic field) at the place the belt electrode assemblies are located. The belt electrode assemblies may be of any length in the longitudinal (z) direction, but preferably where the belt electrode assemblies only approximate the quadro-logarithmic potential in the region in which they are placed, such as when they are, for example, cylindrical in shape, they are less than ⅓ the length of the distance between the turning points of the main flight path in the two opposing mirrors. More preferably where the belt electrode assemblies are cylindrical in shape, they are less than ⅙ the length of the distance between the turning points of the main flight path in the two opposing mirrors in the longitudinal (z) direction.

In some embodiments, there may be used only one belt electrode assembly, e.g. where one sub-set (i.e. on one side of the main flight path) of arcuate lenses can be supported by one belt electrode assembly and the other sub-set of lenses are also supported by the inner or outer field-defining electrode system. In other embodiments, there may be used two or more belt electrode assemblies, e.g. where the arcuate lenses require support by two belt electrode assemblies. In the case of using two or more belt electrode assemblies the belt electrode assemblies may comprise at least an inner belt electrode assembly and an outer belt electrode assembly, the inner belt electrode assembly lying closest to the inner field-defining electrode system and the outer belt electrode assembly having greater diameter than the inner belt electrode assembly and lying outside of the inner belt electrode assembly. At least one belt electrode assembly (the outer belt electrode assembly) may be located outside (i.e. at larger distance from the analyzer axis) of the flight path of the beam and/or at least one belt electrode assembly (the inner belt electrode assembly) may be located inside (i.e. at a smaller distance from the analyzer axis) of the flight path of the beam. Preferably, there are at least two belt electrode assemblies preferably placed within the analyzer between the outer and inner field-defining electrode systems, with a belt electrode assembly either side of the flight path (i.e. at different radiuses). In some embodiments the inner and outer field-defining electrode systems do not have a circular cross section in the plane z=constant. In these cases preferably the one or more belt electrode assemblies also do not have a circular cross section in the plane z=constant, but have a cross sectional shape to match those of the inner and outer field-defining electrode systems.

The belt electrode assemblies may, for example, be made of conductive material or may comprise a printed circuit board having conductive lines thereon. Other designs may be envisaged. Any insulating materials, such as printed circuit board materials, used in the construction of the analyzer may be coated with an anti-static coating to resist build-up of charge.

In some preferred embodiments, the one or more arcuate focusing lenses may be supported by the surface of one, or more preferably both, of the inner and outer field defining electrode systems, i.e. without need for belt electrode assemblies. In such cases, the arcuate focusing lenses will of course be electrically insulated from the field defining electrode systems. In such cases, the surface of the arcuate focusing lenses facing the beam may be flush with the surface of the field defining electrode system which they are supported by.

It is preferred that every time the beam crosses the z=0 plane it passes through an arcuate focusing lens to achieve an optimum reduction of beam spreading in the arcuate direction, where the arcuate focusing lens is preferably located either at or near to where the beam crosses the z=0 (i.e. the arcuate focusing lens may be offset slightly from the z=0 plane as in some preferred embodiments described herein). This therefore does not mean that that the beam necessarily passes through an arcuate lens actually on the z=0 plane each time the beam passes the z=0 plane but the lens may instead be offset from the z=0 but is passed through for each pass through z=0. In this context, every time the beam crosses the z=0 plane may exclude the first time it crosses the z=0 plane (i.e. close to an injection point) and may exclude the last time it crosses the z=0 plane (i.e. close to an ejection or detection point). However, it is possible that the beam does not pass through an arcuate focusing lens every time it crosses the z=0 plane and instead passes through an arcuate focusing lens a fewer number times it crosses the z=0 plane (e.g. every second time it crosses the z=0 plane). Accordingly, any number of arcuate focusing lenses is envisaged.

Any suitable type of lens capable of focusing in the arcuate direction may be utilised for the arcuate focusing lens(es). Various types of arcuate focusing lens are further described below.

One preferred embodiment of arcuate focusing lens comprises a pair of opposing lens electrodes (preferably circular or smooth arc shaped lens electrodes, i.e. having smooth arc shaped edges). The opposing lens electrodes may be of substantially the same size or different size e.g. of sizes scaled to the distance from the analyzer axis at which each lens electrode is located. The opposing lens electrodes have potentials applied to them that differ from the potentials that would be in the vicinity of the lens electrodes otherwise (i.e. if the lens electrodes were not there). In preferred embodiments opposing lens electrodes have different potentials applied and the beam of charged particles passes between the pair of opposing lens electrodes which when biased focus the beam in an arcuate direction across the beam, where the lens electrodes are opposing each other in a radial direction across the beam. Where the lenses are supported in belt electrode assemblies as described above, preferably the opposing lens electrodes follow the contour of the belt electrode assembly in which they are supported.

The arcuate focusing may be applied to various types of opposing mirror analyzers that employ orbital particle motion about an analyzer axis, not limited to opposed linear electric fields oriented in the direction of the analyzer axis. Preferably the arcuate focusing is performed in an analyzer having opposed linear electric fields oriented in the direction of the analyzer axis. In a preferred embodiment the arcuate focusing is employed in an analyzer utilising a quadrologarithmic potential.

The two opposing mirrors in use define a main flight path for the charged particles to take. In preferred embodiments a preferred motion of the beam along its flight path within the analyzer is an eccentric helical motion around the inner field-defining electrode system. In these cases the beam flies along the main flight path through the analyzer back and forth in the direction of the longitudinal axis in an eccentric helical path which moves around the longitudinal axis (i.e. in the arcuate direction) in the z=0 plane. In all cases, the main flight path is a stable trajectory that is followed by the charged particles when predominantly under the influence of the main analyzer field. In this context, a stable trajectory means a trajectory that the particles would follow between any entry port and the exit port if uninterrupted (e.g. by deflection), assuming no loss of the beam through energy dissipation by collisions or defocusing. Preferably a stable trajectory is a trajectory followed by the ion beam in such a way that small deviations in initial parameters of ions result in beam spreading that remains small relative to the analyzer size over the entire length of the trajectory. In contrast, an unstable trajectory means a trajectory that the particles would not follow between any entry port and the exit port if uninterrupted, assuming no loss of the beam through energy dissipation by collisions or defocusing. The main flight path accordingly, does not comprise a flight path of rapidly progressively decreasing or increasing radius. However the main flight path does comprise a path which oscillates in radius, e.g. an elliptical trajectory when viewed along the analyzer axis, a plurality of oscillations being performed. The main analyzer field is generated when the inner and outer field defining electrode systems of each mirror are given a first set of one or more analyzer voltages. The term first set of one or more analyzer voltages herein does not mean that the set of voltages is the first to be applied in time (it may or may not be the first in time) but rather it simply denotes that set of voltages which is given to the inner and outer field-defining electrode systems to make the charged particles follow the main flight path. The main flight path is the path on which the particles spend most of their time during their flight through the analyzer. The main flight path has an average radial distance from the analyzer axis i.e. an average radius.

The ion beam may travel at one period of time upon the main flight path and be induced to travel for another period of time upon a second main flight path, the second main flight path having a different average radius than that of the main flight path. The ion beam may later be induced to move back to the main flight path, be induced to move onto a third or any number of further main flight paths having different average radii from each other, or may leave the analyzer through the exit port. To induce the ion beam to move from one main flight path to another main flight path, electrodes adjacent a main flight path may be used which when energised deflect the ion beam from one main flight path to another. In a preferred embodiment the analyzer comprises a plurality of sets of electrodes which when energised produce three-dimensional perturbations to the electric field within one or both the ion mirrors so as to induce arcuate focusing of ions when they pass through the perturbed electric field and some of the sets of electrodes have electrical potentials applied to them so that ions passing in the vicinity of the said some of the sets of electrodes are directed to a second main flight path having a different average radius than the main flight path. In this way, one or more of the sets of electrodes may serve as an arcuate lens when appropriately energised, or as a beam deflector when differently energised.

All main flight paths are preferably also stable paths within the analyzer. In the case where the second main flight path is stable, the beam may traverse the analyzer once again on the second main flight path, thereby substantially increasing the total flight path and enabling in some embodiments at least doubling the flight path length through the analyzer thereby increasing resolution of the TOF separation. One or more sets of electrodes are preferably also provided adjacent the second main flight path for constraining the arcuate divergence of the ions of interest on the second main flight path. One or more additional belt electrode assemblies or other means may be provided, e.g. to support additional arcuate lenses to focus the beam on the second main flight path. The additional belt electrode assemblies may support or be supported by belt electrode assemblies existing for the first main flight path, e.g. via a mechanical structure. Optionally, such additional belt electrode assemblies may be provided with field-defining elements protecting them from distorting the field at other points in the analyzer. Such elements could be: resistive coatings, printed-circuit boards with resistive dividers and other means known in the art. Optionally, in addition to the second main flight path, the same principle may be applied to provide third or higher main flight paths if desired, e.g. by ejecting to the third main flight path from the second main flight path and so on. Each such main flight path preferably has one or more sets of electrodes adjacent each such main flight path for constraining the arcuate divergence of the ions of interest. Optionally, after traversing the second (or higher) main flight path, the beam may be ejected back to the first (or another) main flight path, e.g. to begin a closed path TOF.

The charged particle beam may enter the analyzer volume through an aperture in one or both of the outer field-defining electrode systems of the mirrors, or through an aperture in one or both of the inner field-defining electrode systems of the mirrors. The injector is preferably substantially located outside the analyzer volume. The injector may accordingly be located outside the outer field-defining electrode systems of the mirrors, or inside the inner field-defining electrode systems of the mirrors.

Various types of injector can be used with the present invention, including but not limited to pulsed laser desorption, pulsed multipole RF traps using either axial or orthogonal ejection, pulsed Paul traps, electrostatic traps, and orthogonal acceleration. Preferably, the injector comprises a pulsed charged particle source, typically a pulsed ion source, e.g. a pulsed ion source as aforementioned. Preferably the pulsed charged particle source is an external storage device located upstream of the entry port of the analyzer and comprises an RF or electrostatic trap, the trap being either filled or unfilled with gas, the external storage device being used to inject ions into the analyzer through the entry port. Preferably the injector provides a packet of ions of width less than 5-20 ns. Most preferably the injector is a curved trap such as a C-trap, for example as described in WO 2008/081334. There is preferably a time of flight focus at the detector surface or other desired surface. To assist achievement of this, preferably the injector has a time focus at the exit of the injector. More preferably the injector has a time focus at the start of the main flight path of the analyzer. This could be achieved, for example, by using additional time-focusing optics such as mirrors or electric sectors. Preferably, voltage on one or more belt electrode assemblies is used to finely adjust the position of the time focus. Preferably, voltage on belts is used to finely adjust the position of the time focus.

The charged particles that pass through the exit port may enter a receiver. As used herein, a receiver is any charged particle device that forms all or part of a detector or device for further processing of the charged particles. Accordingly the receiver may comprise, for example, a post accelerator, a conversion dynode, a detector such as an electron multiplier, a collision cell, an ion trap, a mass filter, a mass analyzer of any known type including a TOF or EST mass analyzer, an ion guide, a multipole device or a charged particle store. In a preferred embodiment the analyzer comprises an exit port and a detector is located downstream of the exit port. In another preferred embodiment the analyzer comprises an exit port and downstream of the exit port is located an ion gate for selecting ions of one or a plurality of ranges of narrow m/z from the separated train of ions. Ion gates are well known in the art, and include simple deflectors and Bradbury-Nielsen gates. There is preferably a fragmentor downstream of the ion gate, for fragmenting the ions selected by the ion gate, and further preferably a mass analyzer downstream of the fragmentor for mass analysing the fragmented ions. The fragmentor may be used to implement any of CID, HCD, ETD, ECD, or SID. The mass analyzer may comprise any type of mass analyzer suitable for receiving ions from a fragmentor.

The analyzer of the present invention may be coupled to an ion generating means for generating ions, optionally via one or more ion optical components for transmitting the ions from the ion generating means to the analyzer of the present invention. Typical ion optical components for transmitting the ions include a lens, an ion guide, a mass filter, an ion trap, a mass analyzer of any known type and other similar components. The ion generating means may include any known means such as EI, CI, ESI, MALDI, etc. The ion optical components may include ion guides etc. The analyzer of the present invention and a mass spectrometer comprising it may be used as a stand-alone instrument for mass analysing charged particles, or in combination with one or more other mass analyzers, e.g. in a tandem-MS or $MS^n$ spectrometer. The analyzer of the present invention may be coupled with other components of mass spectrometers such as collision cells, mass filters, ion mobility or differential ion mobility spectrometers, mass analyzers of any kind etc. For example, ions from an ion generating means may be mass filtered (e.g. by a quadrupole mass filter), guided by an ion guide (e.g. a multipole guide such as flatapole), stored in an ion trap (e.g. a curved linear trap or C-Trap), which storage may be optionally after processing in a collision or reaction cell, and finally injected from the ion trap into the analyzer of the present invention. It will be appreciated that many different configurations of components may be combined with the analyzer of the invention. The present invention may be coupled, alone or with other mass analyzers, with one or more another analytical or separating instruments, e.g. such as a liquid or gas chromatograph (LC or GC) or ion mobility spectrometer.

DETAILED DESCRIPTION

In order to more fully understand the invention, various embodiments of the invention will now be described by way of examples only and with reference to the Figures. The embodiments described are not limiting on the scope of the invention.

Figure 1:
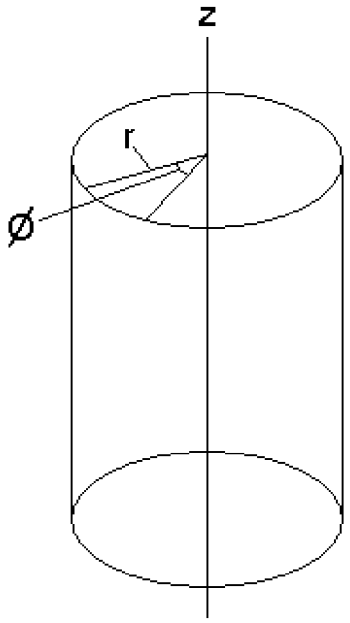
FIG. 1 illustrates the coordinate system used to describe features of the present invention.
Figure 2:
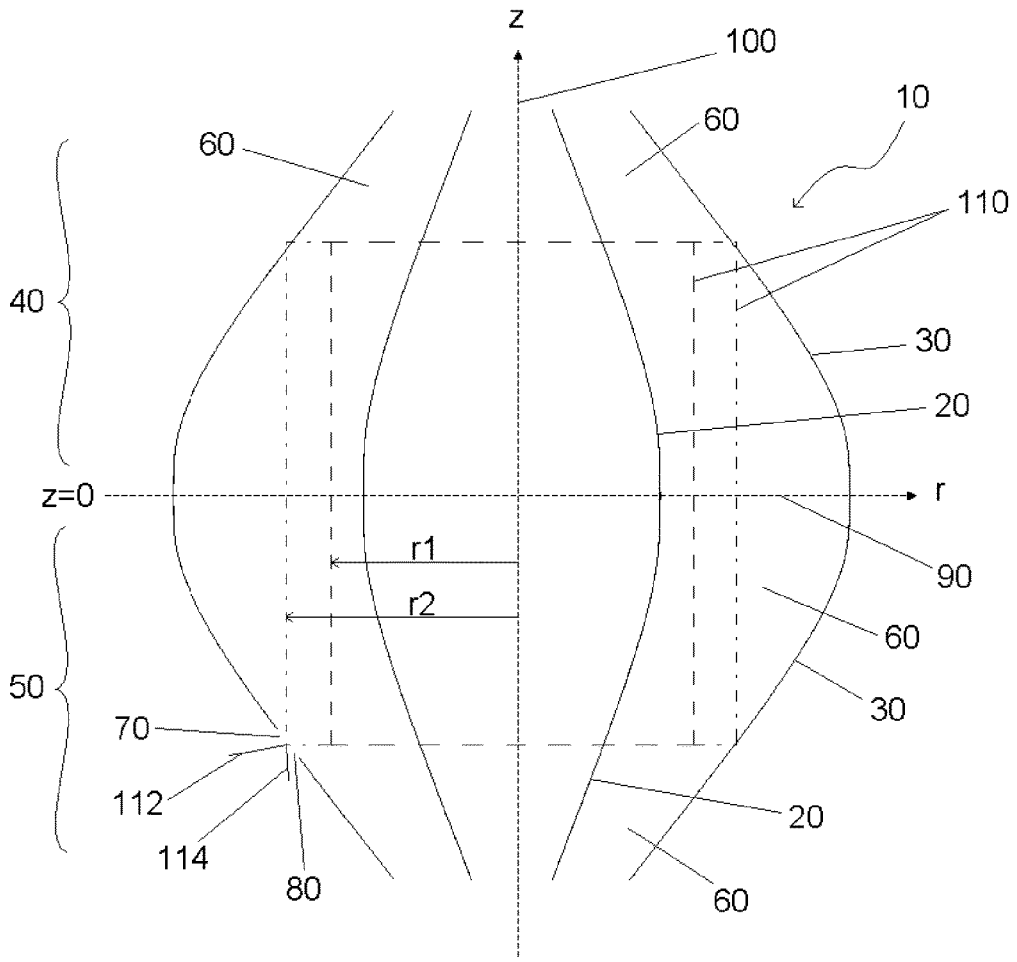
FIG. 2 shows a schematic cross-sectional view of the inner and outer field defining electrode structures of the two opposing mirrors for a preferred embodiment of the invention.

One preferred embodiment of the present invention utilises the quadro-logarithmic potential distribution described by equation (1) as the main analyzer field. FIG. 2 is a schematic cross sectional side view of the electrode structures for such a preferred embodiment. Analyzer 10 comprises inner and outer field-defining electrode systems, 20, 30 respectively, of two opposing mirrors 40, 50. The inner and outer field-defining electrode systems in this embodiment are constructed of gold-coated glass. However, various materials may be used to construct these electrode systems: e.g. Invar; glass (zerodur, borosilicate etc) coated with metal; molybdenum; stainless steel and the like. The inner field-defining electrode system 20 is of spindle-like shape and the outer field-defining electrode system 30 is of barrel-like shape which annularly surrounds the inner field-defining electrode system 20. The inner field-defining electrode systems 20 and outer field-defining electrode systems 30 of both mirrors are in this example single-piece electrodes, the pair of inner electrodes 20 for the two mirrors abutting and electrically connected at the z=0 plane, and the pair of outer electrodes 30 for the two mirrors also abutting and electrically connected at the z=0 plane, 90. In this example the inner field-defining electrode systems 20 of both mirrors are formed from a single electrode also referred to herein by the reference 20 and the outer field-defining electrode systems 30 of both mirrors are formed from a single electrode also referred to herein by the reference 30. The inner and outer field-defining electrode systems 20, 30 of both mirrors are shaped so that when a set of potentials is applied to the electrode systems, a quadro-logarithmic potential distribution is formed within the analyzer volume located between the inner and outer field-defining electrode systems, i.e. within region 60. The quadro-logarithmic potential distribution formed results in each mirror 40, 50 having a substantially linear electric field along z, the fields of the mirrors opposing each other along z. The shapes of electrode systems 20 and 30 are calculated using equation (1), with the knowledge that the electrode surfaces themselves form equipotentials of the quadro-logarithmic form. Values for the constants k, C and $R_m$ are chosen and the equation solved for one of the variables r or z as a function of the other variable z or r. A value for one of the variables r or z is chosen at a given value of the other variable z or r for each of the inner and outer electrodes and the solved equation is used to generate the dimensions of the inner and outer electrodes 20 and 30 at other values of r and z, defining the inner and outer field-defining electrode system shapes.

For illustration, in one example of an analyzer as shown schematically in FIG. 2, the analyzer has the following parameters. The z length (i.e. length in the z direction) of the electrodes 20, 30 is 380 mm, i.e. +/−190 mm about the z=0 plane. The maximum radius of the inner surface of the outer electrode 30 lies at z=0 and is 140.0 mm. The maximum radius of the outer surface of the inner electrode 20 also lies at z=0 and is 97.0 mm. The outer electrode 30 has a potential of 0 V and the inner electrode 20 has a potential of −2060.7 V in order to generate the main analyzer electrical field in the analyzer volume under the influence of which the charged particles will fly through the analyzer volume as herein described. The voltages given herein are for the case of analysing positive ions. It will be appreciated that the opposite voltages will be needed in the case of analysing negative ions. The values of the constants of equation (1) are: $k=1.54*10^5$ V/m$^2$, $R_m$=296.3 mm, C=0.0. Ions enter the analyzer and start upon the main flight path at radius 100 mm and z=−157.3 mm.

The inner and outer field-defining electrode systems 20, 30 of both mirrors are concentric in the example shown in FIG. 2, and also concentric with the analyzer axis z 100. The two mirrors 40, 50 constitute two halves of the analyzer 10. A radial axis is shown at the z=0 plane 90. The analyzer is symmetrical about the z=0 plane. For a TOF analyzer of this size able to achieve high mass resolving power such as 50,000, the alignment of the mirror axes with each other should be to within a few hundred microns in displacement and between 0.1-0.2 degrees in angle. In this example, the accuracy of shape of the electrodes is within 10 microns. Ions would travel on a stable flight path through the analyzer even at much higher misalignment but the mass resolving power would reduce.

Analyzer 10 of FIG. 2 has entry port 70 in the outer field-defining electrode system of mirror 50, and exit port 80 in the outer field-defining electrode system of mirror 50. In this preferred embodiment exit port 80 and entry port 70 comprise the same aperture in the outer field-defining electrode system of mirror 50. Ions enter the analyzer volume 60 through entry port 70 along trajectory 112. The main flight path within analyzer 10 is an eccentric helix envelope 110 having a minimum radius r1 and a maximum radius r2 from the analyzer axis 100. The maximum radius r2 of main flight path envelope 110 is close to the inner surface of outer field-defining electrode 30 at four points in the cross-sectional view of the figure. One of those points lies at entry port 70 and exit port 80. The eccentric helix envelope 110 would, if the ion beam followed the main flight path for sufficient time, strike the inner surface of the outer field-defining electrode of one or other of the mirrors 40, 50. However the trajectory parameters of the ion beam on entry are chosen so that the ion beam extends to its maximum radius r2 at locations closer to the z=0 plane at all times along the flight path until the ions reach exit port 80 and ions following the main flight path do not collide with the inner surface of the outer field-defining electrode. On reaching exit port 80 the ions pass through the exit port 80 and leave the analyzer volume 60 along trajectory 114. In this example, r1 is approximately 100 mm, r2 is 140 mm and the beam extends to a maximum z dimension of 157 mm. The ion beam undergoes repeated oscillations in the direction of the z axis as it reflects from mirror 40 to mirror 50 and back again. Each oscillation in the direction of the z axis is simple harmonic motion.

In a particular embodiment of this example, a beam of ions following the main flight path has an arcuate velocity corresponding to 3000 eV kinetic energy and no axial velocity upon entering the analyzer through entry port 70. The maximum total beam energy reaches 4908.1 eV. In this particular embodiment, after 36 full oscillations along z (equal to 72 passes across the z=0 plane), the beam travels an effective path length of approximately 35.6 m in the analyzer axial direction, which is the direction of time of flight separation of the ions, before reaching its starting point once again. This is due to the particles travelling the z length of the cylindrical envelope 110 twice (i.e. back and forth) for each full oscillation along z (i.e. a distance per oscillation of 157 mm×2=314 mm but an effective distance of 157 mm×27=988 mm). For 36 full oscillations, the total effective length travelled is therefore 988 mm×36=35.6 m. The beam orbits around the z axis just over once (i.e. 5 degrees over) per reflection from one of the mirrors, i.e. just over twice (i.e. 10 degrees over) per full oscillation along the z axis. During this travel ion beam approaches so closely to the outer electrode that a significant proportion of the beam could be lost or scattered in this particular embodiment of the example. To avoid this, the analyzer further comprises arcuate lenses as will be further described. The arcuate lenses are formed from sets of electrodes; a set may consist of a single electrode. To prevent the ion beam approaching too close to the outer electrodes of the mirrors 30, when the ion beam approaches a first arcuate lens, the electrode(s) of the first lens are energised to deflect the ion beam onto a second main flight path, the second main flight path having a smaller average radius than the average radius of the main flight path, so that, for example, r1 is reduced from 100 mm to 99 mm. The ions then proceed to oscillate from one ion mirror to the other without approaching too closely the outer electrode 30 of the mirrors, during which ion separation occurs. During this time all arcuate focusing lenses are energised to produce localised perturbed electric fields which provide arcuate focusing. Finally, upon reaching the last arcuate lens the electrode(s) of the last arcuate lens are energised to deflect the ion beam back onto the main flight path.

A further example (Example B) of the invention utilises a similar analyzer to that described above (Example A), but alternative values for some constants, dimensions and potentials are used. Table 1 shows the constants, dimensions and potentials which differ between the two examples, all other values being the same for both examples and being as detailed above.

TABLE 1

| Parameter | Example A | Example B |
|---|---|---|
| Maximum radius of the outer surface of the inner electrode | 97.0 mm | 94.5 mm |
| Outer electrode potential | 0 V | 0 V |
| Inner electrode potential | −2060.74 V | −1976 V |
| k | $1.54^* 10^5$ V/m$^2$ | $5.4^* 10^5$ V/m$^2$ |
| $R_m$ | 296.3 mm | 179.0 mm |
| Maximum distance of the main flight path from the z = 0 plane | 157 mm | 77.3 mm |
| Total effective length of flight path | 35.6 m | 17.5 m |
| Potential of the inner belt electrode assembly | −2050 V | −1966 V |
| Potential of the outer belt electrode assembly | −1683 V | −1288 V |
| Inner radius of the outer belt | 103 mm | 106 mm |
| Belt electrode assembly z length | 44 mm | 50 mm |
| Offset distance of arcuate lenses from the z = 0 plane | 3.05 mm | 3.2 mm |

As previously described, in the absence of the action of the arcuate lenses, whilst travelling upon the main flight path, the beam is confined radially but is unconstrained in its arcuate divergence within the analyzer. Without arcuate focusing with ion beams having significant arcuate beam divergence only a very limited path length within the analyzer is possible without substantial beam broadening, causing the attendant problems of ejection and detection as already described. The lens electrodes are mounted within the belt electrode assemblies upon insulators which thereby insulate the lens electrodes from the belt electrode assemblies. In other embodiments, the lens electrodes can be part of the belt electrode assembly.

The electrical potentials applied to the belt electrode assemblies may be varied independently of the potentials upon the inner and outer field-defining electrode systems or the lens electrodes.

The spatial spread of the ions of interest in the arcuate direction ϕ should not exceed the diameter of the lens electrodes of the arcuate lenses so that large high-order aberrations are not induced. This imposes a lower limit upon the potential applied to the lens electrodes. Large potentials applied to the lens electrodes should also be avoided so that distortions of the main analyzer field are not produced. The arcuate lenses also affect the ion beam trajectory in the radial direction to some extent, introducing some beam broadening in the radial direction, larger beam broadening occurring to those ions that start their trajectories with larger initial displacements radially.

Figure 3:
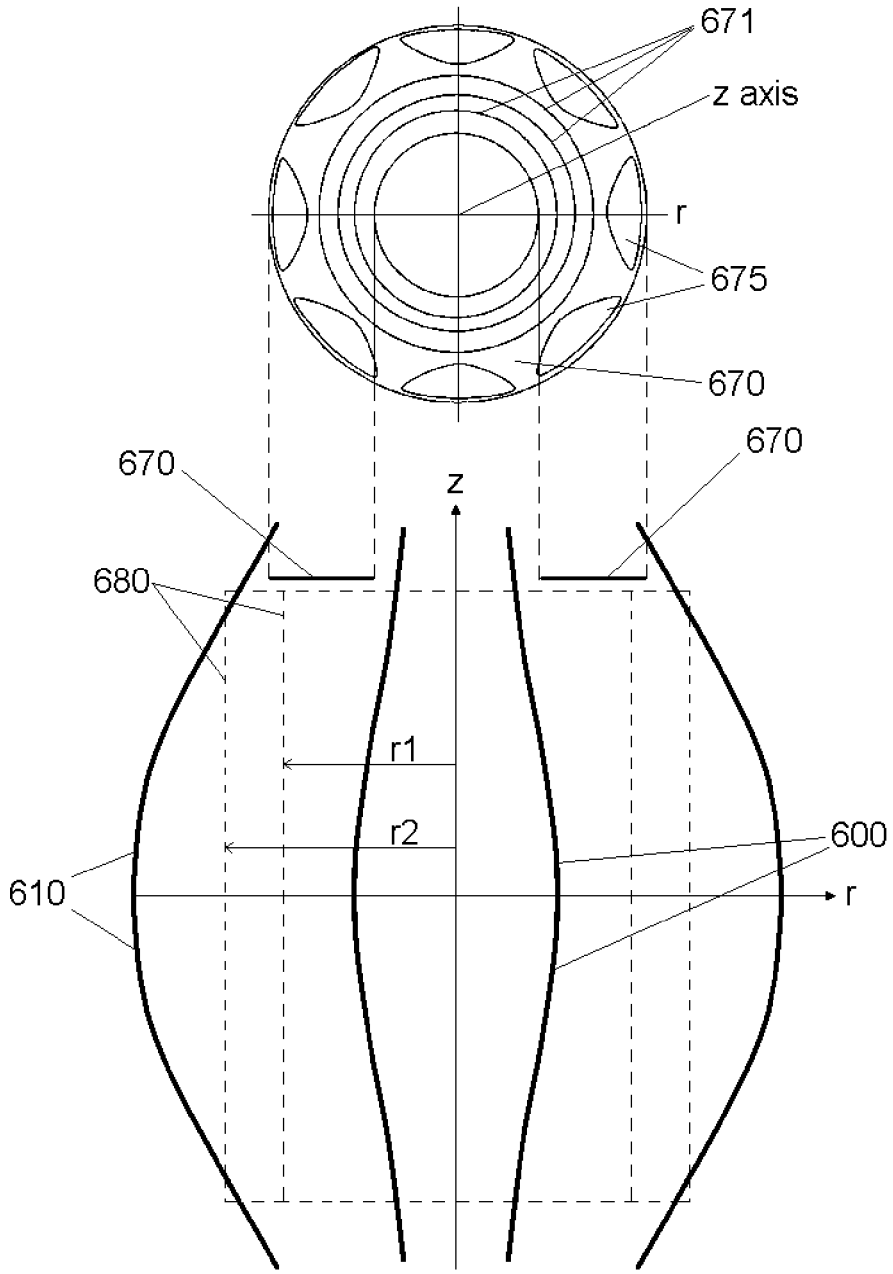
FIG. 3 shows schematic views of an arcuate lens system within an analyzer of the present invention.

Electrode assemblies to support arcuate focusing lenses may be positioned anywhere near the main flight path within the analyzer. A preferred embodiment is shown schematically in FIG. 3. In this embodiment a single belt electrode assembly 670 that supports arcuate lenses 675 is located adjacent the main flight path at one of the turning points. FIG. 3 shows both a side view cross section of the analyzer and a view along the z axis of the belt electrode assembly 670 with arcuate lens electrodes 675 equally spaced about the analyzer axis z. Only eight arcuate lens electrodes 675 are shown in this example; in other embodiments there may be more or less; preferably there would be one gap between adjacent arcuate lens electrodes for each full oscillation of the main flight path along the analyzer axis z, so that arcuate focusing of the beam occurs each time the beam reaches the turning point adjacent the belt electrode assembly. The beam envelope in this embodiment is an ellipse 680 having minimum radius r1 and maximum radius r2. Entry and exit ports are not shown in the figure, but may comprise a single or a pair of apertures in the outer field-defining electrode system of one or both the mirrors. Inner field-defining electrode systems of both mirrors 600 are surrounded by outer field-defining electrode structures of both mirrors 610. The belt electrode assembly 670 supporting the arcuate lenses 675 comprises a disc shaped plate with a central aperture through which passes the end of the inner field-defining electrode system 600. Electrode tracks 671 are mounted upon the belt electrode assembly 670, set in insulation. These electrode tracks 671 are each given an appropriate electrical bias to reduce distortion of the main analyzer field in the vicinity of the belt electrode assembly 670.

Figure 4:
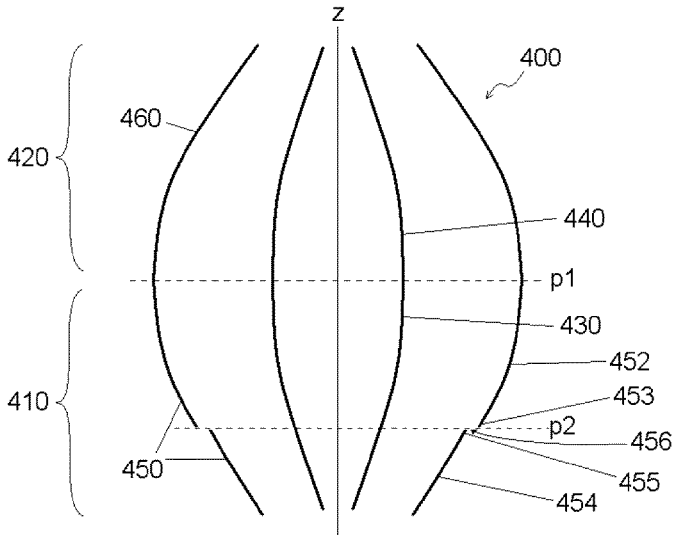
FIG. 4 shows a schematic cross-sectional view of an analyzer of the present invention.

FIG. 4 shows a further preferred embodiment of the present invention in schematic cross-sectional form. Analyzer 400 comprises two opposing mirrors 410 and 420 which abut at a first plane p1, each mirror comprising inner field-defining electrode systems 430, 440 and outer field-defining electrode systems 450, 460 elongated along an analyzer axis z. Outer field-defining electrode system 450 of mirror 410 comprises two sections, the sections abutting at a second plane p2. The two sections comprise a first section 452 between plane p1 and plane p2 and a second section 454 adjacent the first section. The first section 452 has a portion 453 which extends radially from the analyzer axis z a greater extent than an adjacent portion 455 of the second section at the second plane p2. A radial gap 456 is thereby provided through which ions may enter and exit. The radial gap 456 provides an exit port. Where it is desired to introduce ions from a pulsed ion source into the analyzer, radial gap 456 also provides an entry port. In this embodiment the radial gap 456 extends all the way around the analyzer axis and hence the first section of the outer field-defining electrode system is of larger diameter than the second section of the outer field-defining electrode system at the second plane p2.

Figure 5:
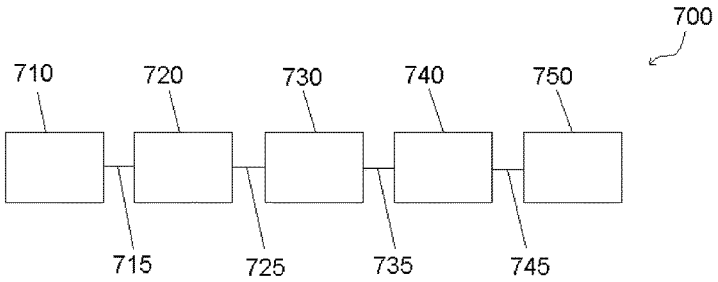
FIG. 5 shows a schematic instrumental layout including the analyzer of the present invention.

Analyzers used with methods of the present invention are able to operate at high resolving powers, such as 20,000 RP to 100,000 RP. Analyzers of the present invention may be used in various instrumental configurations. A preferred instrumental layout 700 is depicted schematically in FIG. 5. An analyzer according to the present invention 720 comprises an entry and an exit port (not shown). Upstream of the analyzer 720 is an injector comprising an external storage device 710. External storage device 710 injects ions 715 into analyzer 720 through the entry port. Analyzer 720 separates at least some of the injected ions according to their mass to charge ratio and the separated train of ions 725 leave the analyzer 720 through the exit port. Separated ions 725 are directed to an ion gate 730 which is switched to select ions of one or more ranges of m/z 735 to proceed on to fragmentor 740. Fragmentor 740 is operated to fragment ions 735 forming fragmented ion beam 745, which passes on to mass analyzer 750 and fragmented ions 745 are mass analyzed.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. An analyser for separating ions according to their time of flight comprising:

a. two opposing ion mirrors abutting at a first plane, each mirror comprising inner and outer field-defining electrode systems elongated along an analyser axis, the outer field-defining electrode system surrounding the inner field-defining electrode system;

b. wherein the outer field-defining electrode system of one mirror comprises two sections, the sections abutting at a second plane, comprising a first section between the first plane and the second plane, and a second section adjacent the first section;

c. wherein the first section has at least a portion which extends radially from the analyser axis a greater extent than an adjacent portion of the second section at the second plane;

d. wherein the first section having at least a portion which extends radially from the analyzer axis a greater extent than an adjacent portion of the second section at the second plane thereby forms a radial gap providing an exit port in the outer field-defining electrode system; and, e. wherein the analyser comprises a detector located downstream of the exit port.

2. The analyser of claim 1 wherein the second plane lies closer to a turning plane of ions within the mirror comprising the two sections, than it does to the first plane.

3. The analyser of claim 2 wherein the second plane lies substantially upon the turning plane of ions within the mirror comprising the two sections.

4. The analyser of claim 1 wherein the opposing ion mirrors produce substantially linear opposing electrostatic fields.

5. The analyser of claim 1 wherein downstream of the exit port is located an ion gate for selecting ions of one or a plurality of ranges of narrow m/z.

6. The analyser of claim 5 wherein downstream of the ion gate is located a fragmentor for fragmenting the ions selected by the ion gate and downstream of the fragmentor is located a mass analyser for mass analysing the fragmented ions.

7. The analyser of claim 1 wherein the exit port is located at the second plane.

8. The analyser of claim 1 wherein the radial gap further provides an entry port through which ions may enter the analyser.

9. The analyser of claim 1 wherein the radial gap extends all the way around the analyser axis.

10. The apparatus of claim 1, wherein the analyser comprises an entry port and an external storage device is located upstream of the entry port, the external storage device comprising an RF or electrostatic trap, the external storage device being used to inject ions into the analyser through the entry port.

* * * * *